US005230470A

United States Patent [19]

Rajan et al.

[11] Patent Number: 5,230,470

[45] Date of Patent: Jul. 27, 1993

[54] FLAME SPRAY APPLICATOR SYSTEM

[75] Inventors: Varagur S. V. Rajan, Sherwood Park; Mario De Rocco, Leduc, both of Canada

[73] Assignees: Alberta Research Council; Canadian Flamecoat Systems, Inc., Alberta, Canada

[21] Appl. No.: 718,215

[22] Filed: Jun. 19, 1991

[51] Int. Cl.[5] ..... B05B 7/30; B05C 5/04

[52] U.S. Cl. ..... 239/8; 239/85; 239/379

[58] Field of Search ..... 239/79, 85, 104, 379, 239/8; 406/50, 192, 194

[56] References Cited

U.S. PATENT DOCUMENTS

| | | | |
|---|---|---|---|
| 3,722,818 | 3/1973 | Hayasaki et al. | 239/85 |
| 4,500,038 | 2/1985 | DeFerrari et al. | 239/85 |
| 4,632,309 | 12/1986 | Reimer | 239/85 X |
| 4,694,990 | 4/1987 | Karlsson et al. | 239/85 X |
| 4,721,252 | 1/1988 | Colton . | |
| 4,740,112 | 4/1988 | Muehlberger et al. | 406/50 |
| 4,759,505 | 7/1988 | Delaplace et al. | 239/85 |
| 4,760,956 | 8/1988 | Mansfield . | |
| 4,835,022 | 5/1989 | Hühne | 239/85 X |
| 4,865,252 | 9/1989 | Rotolico et al. | 239/85 X |
| 4,934,595 | 6/1990 | Reimer | 239/85 X |
| 5,135,166 | 8/1982 | Dietiker et al. | 239/85 X |

*Primary Examiner*—Andres Kashnikow
*Assistant Examiner*—William Grant
*Attorney, Agent, or Firm*—Richard W. Hanes

[57] ABSTRACT

Thermoplastic powder entrained in a stream of carrier gas is conveyed through a carrier gas line extending between a flame spray applicator and a remote supply hopper. A bypass line is included to divert the carrier gas before it reaches the hopper and introduce it into the carrier gas line immediately downstream of the hopper, whereby powder supply from the hopper can be terminated while the carrier gas continues to purge the carrier gas line downstream of the hopper to remove contained powder. The flame applicator delivers fuel gas, combustion air and a carrier gas-powder mixture in separate streams to maximize the quality of the flame and the surface coating. The carrier gas-powder mixture is delivered as a central stream, the combustion air as a generally concentric annular stream around the central stream and the fuel gas as an outermost generally concentric annular stream. The body member is formed with a first central bore for delivering the carrier gas-powder mixture. A removable nozzle member is provided at the outlet end of the first central bore. The size of the nozzle opening can be varied in order to adjust the amount of powder being delivered from the flame applicator.

6 Claims, 5 Drawing Sheets

FLAME SPRAY APPLICATOR SYSTEM

FIELD OF THE INVENTION

This invention relates to a flame spray applicator system for applying powdered material on surfaces. More particularly, the invention relates to improvements in the system for delivering the fuel gas, carrier gas and combustion air to the spray applicator and to improvements in the spray applicator itself.

BACKGROUND OF THE INVENTION

Flame spray applicator systems are used to spray a powdered material such as a thermoplastic (e.g. ethylene acrylic acid copolymers, polyethylene and derivatives) as a coating on a surface (e.g. aluminum). The powder material is entrained in a carrier gas (e.g. air) and delivered to an open atmosphere spray applicator where it is heated to its melting point by a flame (e.g. oxygen-propane) and is propelled against a preheated surface to be coated by the carrier gas.

Flame spray applicator systems for thermoplastic materials are disclosed in U.S. Pat. Nos. 4,934,595 and 4,632,309 issued to Reimer. A flame spray applicator system similar to that disclosed in the former patent is in commercial use. Such flame applicator systems are designed such that the powder material is contained in a conically shaped hopper proximate the spray applicator (spray gun), usually on the operator's back. The controls to operate the flame applicator system (i.e. gas regulators, shut off valves etc.) are numerous and are located on both the hopper and the spray applicator, making the device difficult to fabricate and operate. The inventors of the present invention discovered that, in using the Reimer device, the proximate location of the hopper to the spray applicator often caused the powder to heat up and fuse hindering flow from the hopper, especially when the coating operation was taking place in an enclosed environment. Also, when air was shut off to the spray applicator, the air could backflow through the hopper, rendering the powder airborne. The Reimer device was also found to include a rather elaborate system for delivering the carrier gas to hopper and then to the spray applicator which resulted in a tortuous air flow and a high pressure drop between the carrier gas supply and the spray applicator. This limited the amount of powder which could be entrained in the carrier gas and thus the efficiency of the system. The Reimer device uses a venturi at the base of the hopper to entrain the powder in the carrier gas, however, the pressure drop through the venturi was found to be quite high. Also, adjustment of the venturi tube at the base of the hopper was found to be cumbersome. Finally, the overall design of the flame spray applicator was found to be unnecessarily complex and expensive to machine.

Accordingly, an improved flame applicator system is provided which addresses the above discussed problems associated with the prior art.

SUMMARY OF THE INVENTION

In accordance with the present invention a flame spray applicator system is provided for applying powdered material, preferably thermoplastic material, as a coating on surfaces. In general, the system includes:

a flame spray applicator a powder supply hopper sources of fuel gas, combustion air and carrier gas lines bringing fuel gas to the applicator, combustion air to the applicator and carrier gas to the hopper and then to the applicator; and pressure regulators and valves in the lines to control the delivery of the various gas streams to the applicator.

The hopper assembly is located remotely from the applicator to maintain the powder in a dry, free-flowing form away from the heat of the applicator and away from any hot enclosed environment. The powder is entrained in the carrier gas using venturi action to withdraw the powder from the hopper into the carrier gas line. A bypass line connects with the carrier gas line upstream and immediately downstream of the hopper. Means are provided for diverting the carrier gas through the bypass line, thereby terminating withdrawal of the powder and purging powder remaining in the carrier gas line downstream of the hopper. The bypass line and the diverting means allow an operator to terminate powder supply to the applicator without shutting off the supply of carrier gas to the applicator. Also, the diverting of the carrier gas into the carrier gas bypass line isolates the hopper such that backflow of the carrier gas to the hopper is eliminated. The purging of the powder remaining in the carrier gas line downstream of the powder feeding means minimizes plugging of the line.

The preferred embodiment of the diverting means comprises:

normally open pneumatic valves in the carrier gas line at points upstream and immediately downstream of the hopper, a normally closed pneumatic valve in the bypass line, a source of instrument control gas, an instrument control gas line connecting each of the pneumatic valves to the source of instrument control gas; and a switch controlled valve in the instrument control line, whereby opening the switch controlled valve causes instrument control gas to flow in the instrument control gas line to close the normally open pneumatic valve, open the normally closed pneumatic valve, and divert the carrier gas into the carrier gas bypass line.

The switch control or trigger for the switch controlled valve and the pressure regulating means for the carrier gas are preferably located on a control pack proximate the flame spray applicator to provide convenient remote control of the system by the operator.

In the preferred embodiment of the invention the venturi action for drawing powder from the hopper is adjustable. The hopper is part of a hopper assembly having means for feeding the powder into the carrier gas line. The powder feeding means includes:

a powder conveying conduit into which the powder from the hopper is gravity fed, the conduit being connected at its ends to the carrier gas line;

a hollow venturi tube in the powder conveying conduit having an area of constricted diameter relative to the internal diameter of the powder conveying conduit to cause the venturi action; and means for securing the venturi tube in the powder conveying conduit which allow for translating movement of the venturi tube to adjust, as needed, the rate of powder being drawn into the powder conveying conduit.

In a preferred embodiment of the invention, the flame spray applicator provides for the adjustment of the amount of thermoplastic powder delivered therethrough. To that end, the applicator comprises a generally cylindrical main body member having distal (flame outlet) and proximate (gas inlet) ends and a first central bore extending therethrough defining the carrier gas-powder conveying duct. The applicator also includes a detachable nozzle member at the distal end having a second central bore extending therethrough for alignment with the first central bore. The nozzle member can be removed, without disassembling the applicator itself, and replaced with nozzle members having varying diameter central bores to vary the pressure drop through the applicator and thus the amount of powder delivered therethrough.

In order to maximize the quality of the flame and the molten powder coating, the flame spray applicator delivers the carrier gas-powder mixture as a central stream with the streams of combustion air and fuel gas being delivered as separate generally concentric annular streams. To achieve this, the applicator includes a cylindrical mixing shroud at the distal end defining a combustion chamber within its cylindrical wall into which the gas streams are fed. The applicator includes a first annular chamber at its distal end between the body member and the nozzle member. The first annular chamber is concentric with and outwardly spaced from the first central bore. Combustion air is fed to the first annular chamber through a combustion air conveying duct in the body member. The nozzle member forms a plurality of passageways for exit of the combustion air into the combustion chamber in an annular stream concentric with the first central bore. The applicator further comprises a second annular chamber formed in the body member at its distal end concentric with the first central bore and spaced outwardly from the first annular chamber. The second annular chamber opens into the combustion chamber. The fuel gas is fed to the second annular chamber through a fuel gas conveying duct formed in the body member.

Preferably, deflecting means are provided at the proximate end of the second annular chamber to narrow the diameter of the second annular chamber and to deflect the fuel gas as it exits the second annular chamber toward the inwardly facing cylindrical wall of the mixing shroud. The fuel gas is thus delivered into the combustion chamber in a generally concentric annular steam around the stream of combustion air, but is preferably outwardly deflected from the stream of combustion air. Delivering the powder, air and gases in this manner is found to form a flame around and spaced from the central powder stream.

DETAILED DESCRIPTION OF THE PREFERRED EMBODIMENTS

Figure 1:
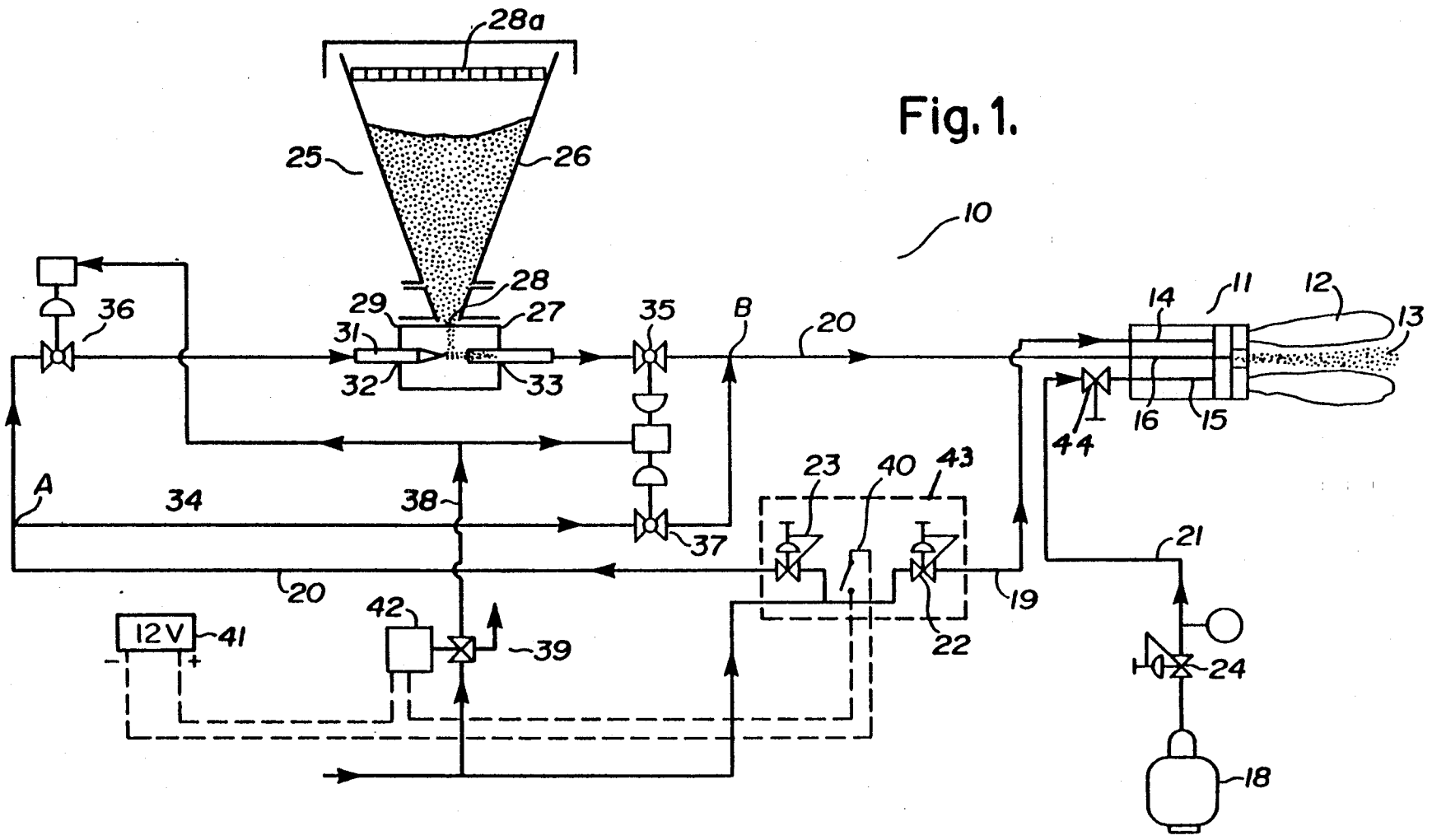
FIG. 1 is a general schematic diagram of the flame spray applicator system of this invention.

The present invention is shown in FIG. 1 to comprise the flame spray applicator system generally at 10. The system 10 includes a flame spray applicator 11 from which a flame 12 and molten thermoplastic powder 13 are delivered. A combustion air conveying duct 14, a fuel gas conveying duct 15 and a carrier gas-powder conveying duct 16 are formed in the applicator 11. In the preferred embodiment of the invention, the carrier gas is air and the fuel gas is propane. The combustion air and the carrier gas are delivered from a common supply means, in this case an air compressor (not shown). Alternatively, a pressurized source of air or oxygen can be used. The fuel gas is delivered from a pressurized portable tank 18. The fuel gas and air are both supplied at pressure, respectively in the range of 5 to 20 psi and preferably 80–100 psi. A combustion air line 19 connects the compressor to the combustion air conveying duct 14. A carrier gas line 20 connects the compressor to the carrier gas-powder conveying duct 16. A fuel gas line 21 connects the tank 18 to the fuel gas conveying duct 15. Gas pressure regulators 22, 23, and 24 are provided in each of lines 19, 20 and 21 respectively.

The system 10 further includes a hopper assembly 25 comprising an inverted conically shaped gravity feed hopper 26 mounted in a detachable base 27 and having an opening 28 at the bottom thereof. A screen **28*a* is included across the top of the hopper 26 to remove lumps of the powder material. The hopper assembly 25 is located remotely from the applicator 11, that is it is located at a distance sufficient to prevent heat generated at the applicator 11 from heating the powder contained therein to an extent that the powder is no longer dry and free flowing. This also provides sufficient space to a human operator at the applicator 11 to move freely around a surface (not shown) to be coated. A distance of 25 to 30 feet or more has been found to be desirable. Powder feeding means 29 are provided at the base of the hopper 26 and comprises a powder conveying conduit tube 30 (best illustrated in FIG. 4) into which the powder from the hopper 26 is fed, and a hollow venturi tube 31. The inlet end 32 and the outlet end 33 of the powder conveying conduit 30 are connected to the carrier gas line 20. Powder is drawn from the hopper 26 into the powder conveying conduit 30** by venturi action in a manner that will be hereinafter described.

The system 10 includes a bypass line 34 connecting with the carrier gas line 20 at points upstream (i.e. compressor side) and immediately downstream (i.e. applicator side), shown at points A and B respectively in FIG. 1, of the powder feeding means 29. The carrier gas is diverted into the bypass line 34 when powder supply in the carrier gas line 20 downstream of the powder feeding means 29 is to be terminated. A first normally open pneumatic two way ball valve 35 is provided in the carrier gas line 20 downstream of the powder feeding means 29 and upstream of point A. A second normally open pneumatic two way ball valve 36 is provided in the carrier gas line 20 upstream of the powder feeding means 29 and downstream of point B. A normally closed pneumatic two way ball valve 37 is provided in the bypass line 34. An instrument control gas line 38 is included to connect each of the pneumatic valves 35, 36, and 37 to a source of instrument control gas, preferably by connecting with the carrier gas line 20. A switch controlled valve assembly 39 is provided in the instrument control gas line 38. The valve assembly 39 comprises an on-off electrical toggle switch 40 connected to a 12 V battery 41 and a solenoid valve 42 in the instrument control gas line 38. The pneumatic valves 35, 36, and 37, the instrument control gas line 38, and the switch controlled valve assembly 39 combine to form means to divert the carrier gas from the carrier gas line 20 into the bypass line 34 to terminate powder supply to the carrier gas line 20 immediately downstream of the powder feeding means 29 and to purge powder remaining in the carrier gas line 20 in that downstream portion. More particularly, operating the toggle switch 40 opens the solenoid valve 42 causing instrument control gas, preferably carrier gas, to flow in the instrument control gas line 38. This flow closes the normally open pneumatic valves 35 and 36 in the carrier gas line 20 and opens the normally closed pneumatic valve 37 in the carrier gas bypass line to divert the carrier gas into the bypass line 34 and then back into the carrier gas line 20 upstream of the powder feeding means 29.

The carrier gas regulator 23 and the control for the switch controlled valve assembly 39 (i.e. the toggle switch 40) are preferably located on a portable control panel 43 to be worn on the human operator, thus locating the controls proximate the applicator 11. Most preferably the combustion air regulator 22 is located on the same control panel 43. Thus the human operator can remotely control the powder flowrate and the flame quality from the control panel 43. A fuel valve 44 is preferably located at the applicator 11 in the fuel gas line 21. This provides for further remote control of flame quality by the human operator.

Figure 4:
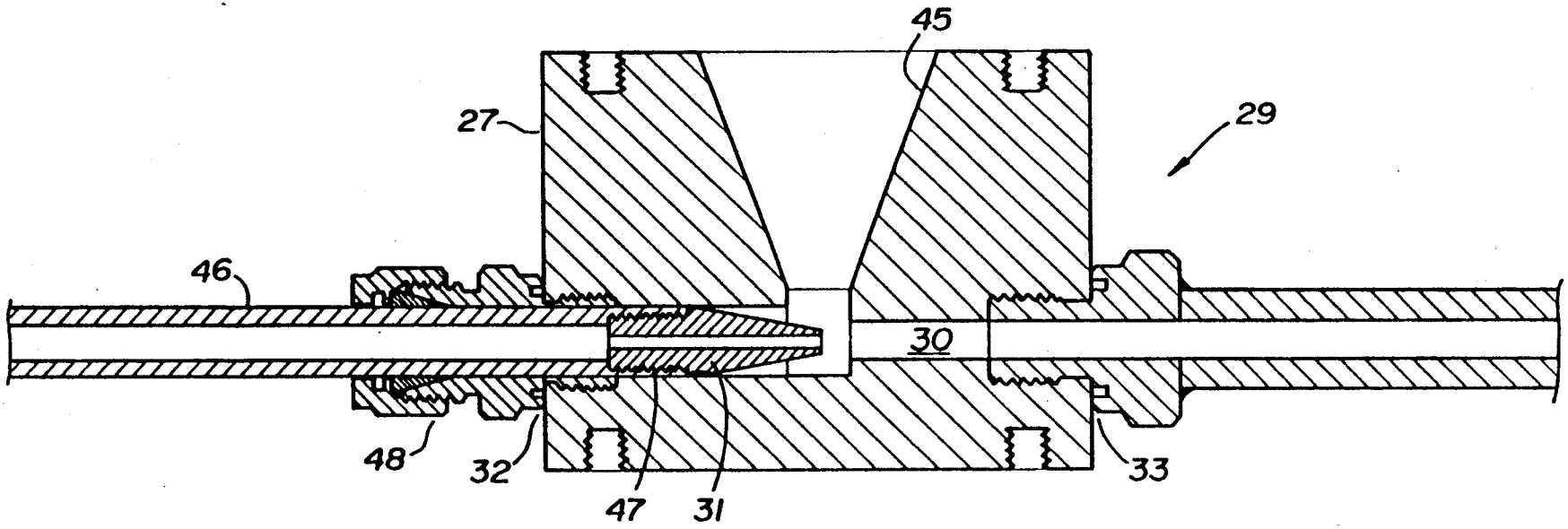
FIG. 4 is a longitudinal sectional view of the hopper showing the powder conveying conduit mounted therebelow.

The powder feeding means 29 is best illustrated in FIG. 4 to comprise the powder conveying conduit 30 and the venturi tube 31 as above-mentioned. The base 27 is formed with a inverted conical shaped opening 45 leading into the powder conveying conduit 30 approximately at its midpoint. The hopper 26 is snugly fitted into the base opening 45 such that powder in the hopper is gravity fed through the hopper opening 28 into the powder conveying conduit 30. The venturi tube 31 is formed to fit tightly into the powder conveying conduit 30. The venturi tube 31 is illustrated to comprise a hollow cylindrical portion 46 and a hollow tapered nozzle portion 47 which mates with the cylindrical portion 46. If desired, the venturi tube 31 can comprise a one piece unit. The inside diameter of the venturi tube 31 narrows at some portion, preferably in the nozzle portion 47 to form an area of constricted diameter relative to the internal diameter of the powder conveying conduit 30. Most preferably the powder conveying conduit 30 has a narrower inside diameter at its outlet end 33 than at its inlet end 32, as shown. The nozzle portion 47 can be manufactured with varying constricted diameters for different powder application rates. The area of constricted diameter in the venturi tube 31 causes powder in the hopper 26 to be drawn into the powder conveying conduit 30 by venturi action.

The venturi tube 31 is secured in the powder conveying conduit 30 by a bore through tube fitting 48 which allows for translating movement of the venturi tube 31 in the powder conveying conduit 30 to adjust, as needed, the rate of powder drawn into the powder conveying conduit 30 by venturi action.

In order to minimize the pressure drop between the applicator 11 and the carrier gas regulator 23 the diameters of the carrier gas line 20, the venturi tube 31, powder conveying conduit 30 and carrier gas-powder conveying duct 16 are kept as close as possible to the same size. Conveniently the carrier gas line 20 is constructed from $\frac{3}{8}$ to about $\frac{1}{2}$ inch hard rubber hose. This same diameter is preferably maintained in the carrier gas-powder conveying duct 16. The powder conveying conduit 30 (i.e. at the outlet end 33) is preferably only narrowed to about $\frac{1}{4}$ inch. The venturi tube 31 is preferably narrowed in the nozzle portion 47 to 0.063–0.073 inches to provide an acceptable balance between venturi action and pressure drop. These dimensions are not critical to the invention, but are included to illustrate exemplary dimension changes which do not result in a significant pressure drop in the carrier gas line 20.

Figure 2:
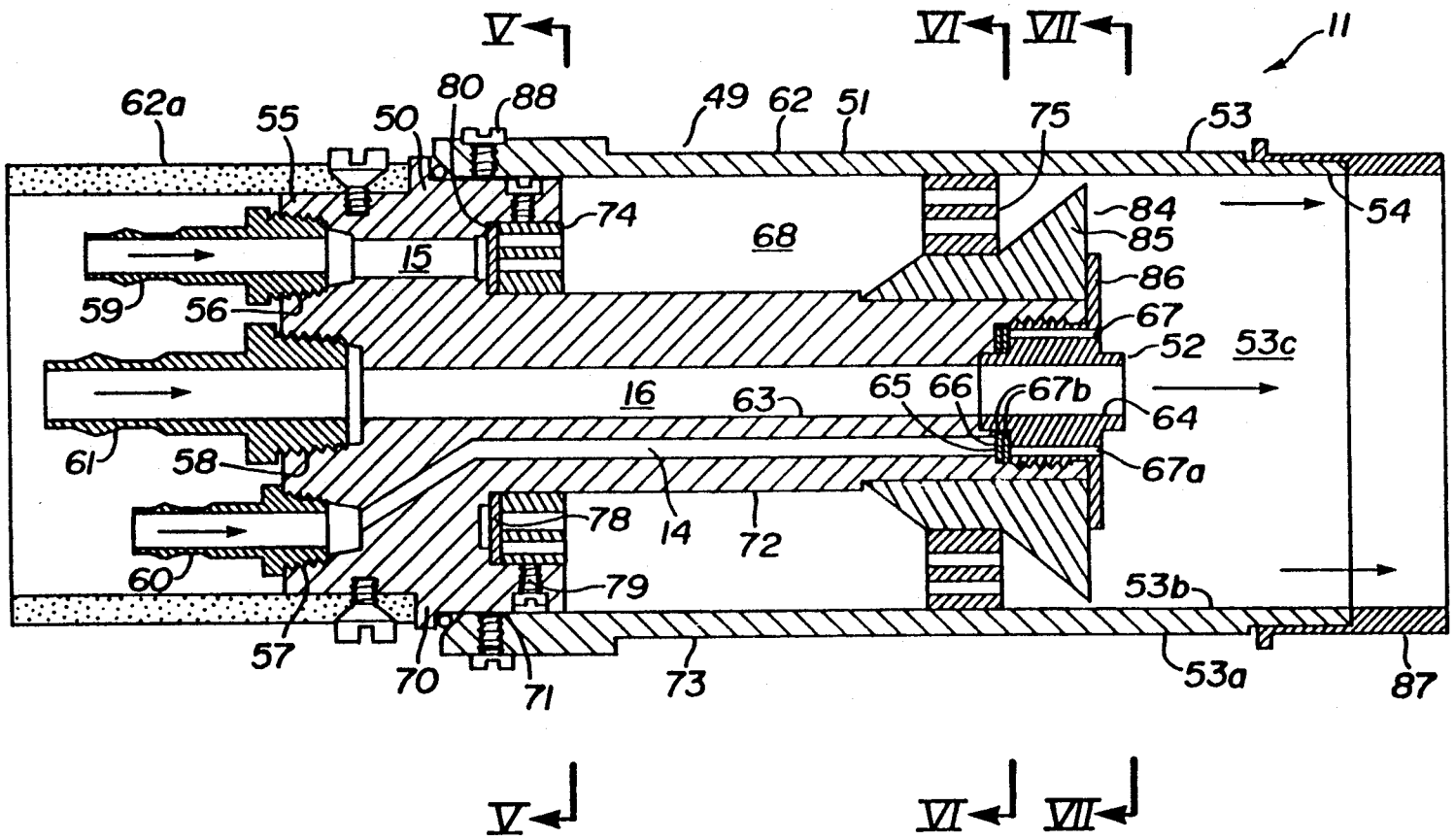
FIG. 2 is a longitudinal sectional view of the flame spray applicator.
Figure 3:
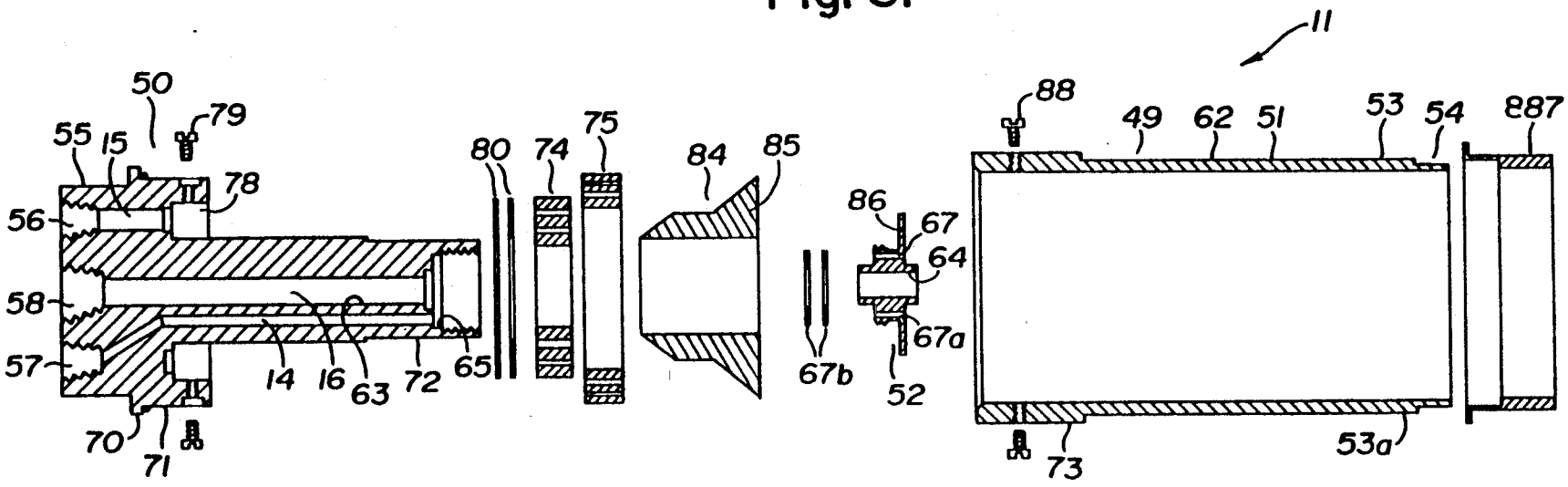
FIG. 3 is an exploded longitudinal sectional view of the flame spray applicator of FIG. 2, showing the two piece body member, the mixing shroud, the detachable nozzle member, and distributor rings for distributing the fuel gas.

The flame spray applicator 11 is illustrated in FIGS. 2, 3, and 5–7. The applicator 11 basically includes a generally cylindrical body member 49, preferably in a first body part 50 and a second body part 51, a detachable nozzle member 52 and a mixing shroud 53. The body member 49, first and second body parts 50 and 52 are each described herein as having a distal end, that is the end most distant from the air or gas supply and a proximate end, that is the end closest to the air or gas supply. Accordingly, the body member 49 is shown in FIG. 2 to have a distal end 54 and a proximate end 55. Other body parts are not so labeled, but it will be understood hereinafter when referring to the distal or proximate end of a particular part that a similar meaning is implied.

The mixing shroud 53 is formed at the distal end 54 of the body member 49. The mixing shroud 53 comprises a cylindrical shroud sleeve **53*a* having an inwardly facing cylindrical wall 53*b*. A combustion chamber 53*c* is defined within the inwardly facing cylindrical wall 53*b***.

The nozzle member 52 is threadably attached at the distal end 54 of the body member 49. The mixing shroud 53 extends forwardly (i.e. more distally) of the nozzle member 52.

The fuel gas conveying duct 15, the combustion air conveying duct 14 and the carrier gas-powder conveying duct 16 each terminate in threaded ports 56, 57, and 58 respectively for attachment to the threaded connectors 59, 60 and 61 of the fuel gas line 21, combustion air line 19 and the carrier gas line 20 respectively. A nonmetalic cylindrical shield **62*a* is attached at the proximate end 55 of the body member 49 to protect the connectors 59, 60 and 61**, and also serves as a handle for the operator.

The body member 49 forms an outer generally cylindrical wall 62 and a first central bore 63. The bore 63 extends through the body member 49 and defines the carrier gas-powder conveying duct 16.

The detachable nozzle member 52 forms a second central bore 64 extending therethrough in alignment with the first central bore 63. The diameter of the bores 63 and 64 is preferably the same for maximum delivery of the powder. However, if a lesser amount of powder is to be delivered through the applicator 11, a nozzle member 52 with a different bore diameter may be attached.

The body member 49 is formed with a first recessed annular ring 65 machined into the distal end 54. When the nozzle member 52 is attached, a first annular chamber 66 is formed between the nozzle member 52 and the body member 49. The first recessed annular ring 65 is formed such that the first annular chamber 66 is concentric with the first central bore 63. The combustion air conveying duct 14 is formed to communicate with the first annular chamber 66. Passageways 67 are formed in the nozzle member 52 extending from the first annular chamber 66 to the combustion chamber 53*c*. As illustrated in FIG. 10, the passageways 67 preferably comprise a ring of circumferentially spaced holes 67*a* around the second central bore 64. One or more combustion air screens 67*b* is provided in the first annular chamber 66 to prevent debris from entering the passageways 67 and to provide uniform distribution of the air to all the holes 67*a*.

The body member 49 is formed with a second annular chamber 68 at its distal end 54, concentric with the first central bore 63, spaced outwardly from the first annular chamber 66, and opening into the combustion chamber 53*c*. The fuel gas conveying duct 14 is formed in the body member 49 to terminate in the second annular chamber 68.

In the preferred embodiment of the invention, the body member is formed in two parts, as above-mentioned. The first body part 50 comprises a generally cylindrical base portion 70 at the proximate end 55, forming the threaded ports 56, 57, and 58 and the ducts 14, 15, and 16 (first central bore 63). The base portion 70 forms an outer generally cylindrical wall 71 which terminates at a point spaced from the distal end 54. The first body member 50 further comprises a central cylindrical portion 72 of smaller outside diameter than that of the base portion 70, but sufficient to enclose the first central bore 63, and the combustion air conveying duct 14. The central cylindrical portion 72 extends from the base portion 70 to the distal end 54.

The second body part 51 comprises a hollow generally cylindrical sleeve 73 which is connected at its proximate end to the outer cylindrical wall 71 of the base portion 70. The mixing shroud 53 is formed at the distal end of the cylindrical sleeve 73. The hollow cylindrical sleeve 73 has an outer diameter similar to that of the base portion 70. The second annular chamber 68 is formed between the hollow cylindrical sleeve 73 and the central cylindrical portion 72 of the first body part 50.

Figure 5:
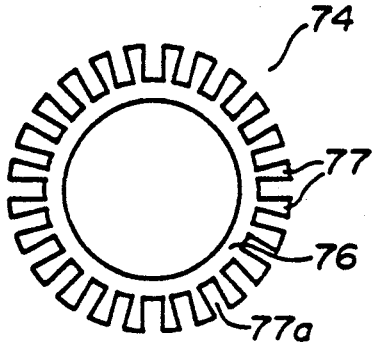
FIG. 5 is an end view of the first distributor ring viewed along line 5—5 of FIG. 2.

Preferably, first and second distributor rings 74, 75 are provided in the second annular chamber 68, to distribute fuel gas uniformly in the chamber before it enters the combustion chamber 53*c*. The first distributor ring 74 is shown in FIGS. 2 and 5 to comprise a first hollow ring 76 with a first set of radially spaced fingers 77. The spaces between the fingers 77 provide passages 77*a* for the flow of evenly distributed fuel gas therethrough. The first hollow ring 76 is sized to fit snugly around the central cylindrical portion 72 of the first body part 50. The first distributor ring 74 is seated in a second recessed annular ring 78 machined in the base portion 70, the second recessed annular ring 78 forming the proximate end of the second annular chamber 68. The first distributor ring 74 is held in the second recessed annular ring 78 by retaining screws 79 second body member 52. Preferably one or more fuel gas screens 80 is provided against the upstream side of the first distributor ring 74 to prevent debris from entering the second annular chamber 68 and for better distribution of the fuel gas.

Figure 6:
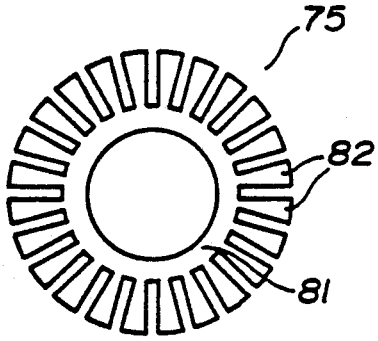
FIG. 6 is an end view of the second distributor ring viewed along line 6—6 of FIG. 2.
Figure 7:
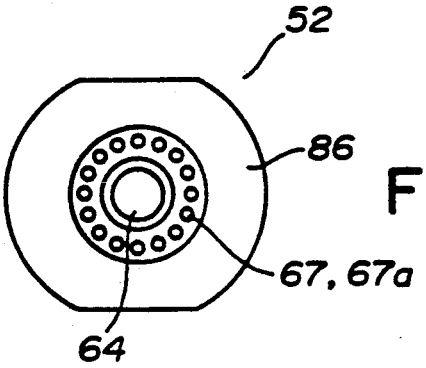
FIG. 7 is an end view of the detachable nozzle member viewed along line 7—7 of FIG. 2.

The second distributor ring 75 is located at the distal end 54 of the body member 49. As best illustrated in FIGS. 2 and 6, the second distributor ring 75 comprises a second hollow ring 81 and a second set of radially spaced fingers 82. Forward (i.e. more distally) of the second distributor ring 75 is deflecting means 84 to narrow the diameter of the second annular chamber 68 and to deflect the fuel gas as it exits the second annular chamber 68 outwardly toward the inwardly facing cylindrical wall 53*b* of the mixing shroud 53. The deflecting means 84 comprises an outwardly flaring ring 85 which fits snugly around the central cylindrical portion 72 of the first body part 50. The nozzle member 52 preferably includes a retaining flange 86 to retain the ring 85 in position. The second distributor ring 75 fits snugly around the ring 85 to position it across the second annular chamber 68.

A detachable flame shaping ring 87 is preferably included at the distal end of the mixing shroud 53 to change the shape of the flame 12 exiting the mixing shroud 53. The shaping ring 87 shown in FIGS. 2 and 3 does not significantly change the flame shape exiting the mixing shroud 53, however, if for example an oval shaped flame was desired, the shaping ring 87 could be shaped accordingly.

As shown in FIG. 2, the first and second body parts 50, 51 are attached together with screws 88. However, it should be understood that the body parts 50, 51 could be manufactured to mate with a tight, locking or threaded fit.

The present invention has been disclosed herein in respect of its preferred embodiments, however, it should be understood that modifications and variations may be made without departing from the spirit and scope of the present invention as defined in the following claims.

We claim:

1. An open atmosphere flame spray applicator system for applying a thermoplastic powdered material from a powder supply on surfaces, comprising:

a flame spray applicator having separate conveying ducts for delivering combustion air, fuel gas and carrier gas-powder mixture therethrough;

means for supplying combustion air, fuel gas and carrier gas;

a combustion air line connecting the combustion air supply means to the combustion air conveying duct;

a fuel gas line connecting the fuel gas supply means to the fuel gas conveying duct;

a carrier gas line connecting the carrier gas supply means to the carrier gas-powder conveying duct;

means for regulating the gas pressure in the combustion air, fuel gas and carrier gas lines;

a hopper assembly containing the powder supply and having means connected thereto for feeding the powder under gravity into the carrier gas line, the hopper assembly being located remotely from the flame spray applicator so as to maintain the powder in a dry, free-flowing form;

a bypass line connecting with the carrier gas line at points upstream and immediately downstream of the powder feeding means; and means for diverting the carrier gas from the carrier gas line into the bypass line to terminate powder supply to the carrier gas line and to purge powder remaining in the carrier gas line downstream of the powder feeding means through the flame spray applicator and to prevent backflow of the carrier gas to the powder feeding means; and wherein the flame spray applicator comprises:

a generally cylindrical body member having distal ends and an outer cylindrical wall, said body member forming a first central bore extending therethrough from the proximate to the distal end, said first central bore defining the carrier gas-powder conveying duct;

a first annular chamber formed in the body member at its distal end concentric with and outwardly spaced from the first central bore;

the combustion air conveying duct being formed in the body member extending from the proximate end and terminating in the first annular chamber;

a detachable nozzle member at the distal end of the body member having a second central bore extending therethrough for alignment with the first central bore of the body member, and having a plurality of circumferentially spaced passageways formed around the second central bore extending through the nozzle member from the first annular chamber;

a mixing shroud at the distal end of the body member extending forwardly of the nozzle member and having an inwardly facing cylindrical wall defining a combustion chamber;

a second annular chamber formed in the body member at its distal end concentric with the first central bore and spaced outwardly from the first annular chamber, said second annular chamber opening into the combustion chamber; and the fuel gas conveying duct being formed in the body member extending from the proximate end and terminating in the second annular chamber.

2. The system of claim 1, wherein the body member includes first and second body parts, the first body part comprising:

a generally cylindrical base portion at the proximate end having an outer generally cylindrical wall which terminates at a point spaced from the distal end; and a generally cylindrical central portion of smaller diameter than the base portion extending concentrically from the base portion to the distal end, said central cylindrical portion forming the first central bore, the combustion air conveying duct and the first annular chamber, the second body part comprising:

a hollow generally cylindrical sleeve for mating attachment with the outer cylindrical wall of the first body part, the second annular chamber being formed between the cylindrical sleeve and the central cylindrical portion of the first body part, and the mixing shroud being formed at the distal end of the cylindrical sleeve.

3. The system of claim 2, wherein at least one distributor means is provided in the second annular chamber to distribute fuel gas evenly around the second annular chamber.

4. The system of claim 3, wherein the distributor means comprise spaced first and second distributor rings, each ring being formed with radially spaced fingers extending across the second annular chamber, the spaces between the fingers providing passages for the flow of fuel gas therethrough, the first distributor ring being located at the proximate end of the second annular chamber, the second distributor ring being located at the distal end of the second chamber.

5. The system of claim 1, wherein deflecting means are provided to narrow the diameter of the second annular chamber and to deflect the fuel gas as it exits the second annular chamber toward the inwardly facing cylindrical wall of the mixing shroud.

6. The system of claim 1, wherein a flame shaping ring is provided at the proximate end of the mixing shroud to change the shape of the flame exiting the mixing shroud.

* * * * *